US006045015A

United States Patent [19]

Waltenspühl et al.

[11] Patent Number: 6,045,015

[45] Date of Patent: Apr. 4, 2000

[54] COUPLING FOR A LINEAR ACTUATOR AND A SLIDING VALVE UNIT FOR A SLIDING GATE VALVE OF A MOLTEN METAL VESSEL

[75] Inventors: Rolf Waltenspühl; Werner Plattner, both of Hünenberg; Peter Christen, Horw, all of Switzerland

[73] Assignee: Stopinc AG, Baar, Switzerland

[21] Appl. No.: 09/069,846

[22] Filed: Apr. 30, 1998

[30] Foreign Application Priority Data

Apr. 30, 1997 [CH] Switzerland ..... 1026/97
Jan. 26, 1998 [CH] Switzerland ..... 0177/98

[51] Int. Cl.[7] ..... B22D 41/08

[52] U.S. Cl. ..... 222/600; 222/597

[58] Field of Search ..... 222/597, 600; 266/236

[56] References Cited

U.S. PATENT DOCUMENTS 4,042,207 8/1977 Nehrlich et al. ..... 222/600
4,596,345 6/1986 Beckers ..... 222/600

FOREIGN PATENT DOCUMENTS 0110028 6/1984 European Pat. Off. .
WO88/0121 2/1988 WIPO .

*Primary Examiner*—Scott Kastler
*Attorney, Agent, or Firm*—Wenderoth, Lind & Ponack, L.L.P.

[57] ABSTRACT

A coupling is used to couple a linear actuator with a slider valve unit in a sliding gate valve for a molten metal vessel. The slider valve unit is slidably mounted in a slider housing for movement in a longitudinal direction, and has a push rod for this purpose. A linear actuator mounting is provided on the slider housing, and the linear actuator is mounted in the linear actuator mounting. The linear actuator has a drive rod movable in a longitudinal direction when the linear actuator is mounted in the linear actuator mounting. The coupling has a structure such that when the linear actuator is mounted in the linear actuator mounting, and the drive rod is moved toward the slider valve unit, the coupling automatically couples the drive rod with the push rod. Furthermore, when the linear actuator is removed from the linear actuator mounting, the coupling automatically uncouples the drive rod from the push rod.

20 Claims, 3 Drawing Sheets

COUPLING FOR A LINEAR ACTUATOR AND A SLIDING VALVE UNIT FOR A SLIDING GATE VALVE OF A MOLTEN METAL VESSEL

BACKGROUND OF THE INVENTION

1. Field of the Invention

The present invention relates to a sliding gate valve for a vessel containing molten metal that includes a slider unit longitudinally guided in a slider housing and having a push rod. The push rod may be connected by a coupling to a drive rod of the linear actuator, a mounting receiving the linear actuator being provided on the slider housing.

2. State of the Prior Art

One known device for actuating a slide gate valve is disclosed in the publication EPA-A -0110028. In this publication, a fixed slider portion is flange connected by a coupling to a linear actuator. A coupling is provided for releasably connecting the removable slider portion to the piston rod of the actuator. The coupling for the flange connection of the linear actuator is constructed as a bayonet coupling. The piston-cylinder unit is pushed in the direction of its axis of movement into the fixed slider portion, and is subsequently secured therein by rotation. In practice, however, this maneuver is not practical, because the piston-cylinder unit is of very heavy construction. The coupling for the releasable connection for the slider portion to the piston rod is constructed so that by moving the piston rod, an element on the front of the piston rod engages a coupling element on the slider unit, and a connection is produced when the cylinder is rotated. This also relies on laborious rotation of the cylinder.

SUMMARY OF THE INVENTION

In view of the prior art discussed above, it is an object of the present invention to provide a sliding gate valve that has a coupling of the type discussed above which uses as simple as possible a manipulation for the positioning or removal of the linear actuator and for the coupling and decoupling of the drive rod of the linear actuator to and from the slider unit.

In accordance with the present invention, the above object is achieved by a coupling that is constructed so that when the linear actuator is slid into a mounting, it automatically couples as a result of movement of its drive rod toward the slider unit, and automatically uncouples when the linear actuator is removed from the mounting in a direction transverse to the direction of movement of the drive rod. Thus with the coupling according to the present invention, the linear actuator can be positioned on the mounting on the slide gate valve, the drive rod can be coupled with the slider unit, and the drive rod can be uncoupled from the slider unit when the linear actuator is removed, in the most simple manner.

The object of the present invention is further achieved by the provision of a sliding gate valve for a molten metal vessel having a slider housing, a slider valve unit slidably mounted in the slider housing for movement in the longitudinal direction, the slider unit having a push rod, and a linear actuator mounting on the slider housing. A linear actuator is provided that can be capable of being mounted in the linear actuator mounting on the slider housing. The linear actuator has a drive rod movable in the longitudinal direction when the linear actuator is mounted in the linear actuator mounting. A coupling has a structure so that when the linear actuator is mounted in the linear actuator mounting, and the drive rod is moved toward the slider valve unit, the coupling automatically couples the drive rod with the push rod. Furthermore, when the linear actuator is removed from the linear actuator mounting, the coupling automatically uncouples the drive rod from the push rod.

The coupling preferably comprises a first coupling portion on an end of the push rod and a second coupling portion on a front end of the drive rod. One of the first and second portions includes at least one pivotally mounted claw element, and the other of the first and second portions includes a flanged coupling portion, so that when the coupling is in the coupled state, the at least one pivotally mounted claw element engages the flanged coupling portion. The at least one claw element preferably includes two pivotally mounted claw elements parallel to each other in the uncoupled state of the coupling, arranged to form pincers. A spring element engages the rear portions of the two pivotally mounted claw elements so as to bias the front portions of the claw elements toward each other.

The flanged coupling portion preferably has a rectangular cross section, an end face facing in the longitudinal direction and guide surfaces on the end face for engaging the claw elements and guiding the claw elements until engaging the flanged coupling portion during movement of the drive rod toward the slider valve unit and coupling of the first coupling portion with the second coupling portion.

The linear actuator mounting, furthermore, preferably has an inner surface facing the push rod, the drive rod and the coupling when the linear actuator is mounted in the linear actuator mounting. The inner surface extends along an operational travel path of the drive rod and the push rod, and includes first and second inner surface portions. The first inner surface portion corresponds to a coupling position at which the coupling is formed between the drive rod and the push rod by the first and second coupling portions. The second inner surface portion corresponds to an operating range of the drive rod along which the drive rod is operated when coupled to the push rod for movement of the slider valve unit. The first inner surface portion is sufficiently large in diameter to permit the claw elements to open so that the first and second coupling portions can be coupled together. The second inner surface portion is sufficiently narrow in diameter to prevent the claw elements from opening to such an extent that the first and second coupling portions could be uncoupled.

The linear actuator mounting has an opening therein so that the linear actuator can be withdrawn therefrom in a direction transverse to the longitudinal direction when the claw elements are engaged with the flanged coupling portion. The claw elements and the flanged coupling portion have mutual contact surfaces. Upon withdrawal of the linear actuator from the linear actuator mounting, the claw elements slide on the flanged coupling portion until being uncoupled. The mutual contact surfaces extend at right angles with respect to the longitudinal direction.

In an alternative embodiment, the first and second coupling portions comprise a central peg having projection pivotal pawls on both sides thereof and a sleeve, respectively. The central peg also has an abutment surface. The sleeve has transverse grooves complementary with and capable of receiving the pivotal pawls of the central peg, as well as a front annular portion. When the first and second coupling portions are coupled with each other, the central peg is slid into the sleeve, the pawls engage the transverse grooves and the front annular portion is located between the pawls and the abutment surface. In this embodiment, the sleeve has an opening on one side thereof so as to permit the central peg and the pawls to slide out of the sleeve in the direction transverse to the longitudinal direction such that the sleeve and the central peg are uncoupled and the pawls are disengaged from the transverse grooves upon withdrawal of the linear actuator through the opening in the linear actuator mounting.

It is noted that the flanged coupling portion preferably has oblique surfaces for engagement with the claw elements in the first embodiment. Furthermore, the claw elements preferably have a spring biasing them into the coupling position. Also, the linear actuator has a guide element guided by a guide surface into a guide groove on the linear actuator mounting.

Preferably the first and second coupling portions have respective complementary surfaces, so that in the coupled position, the first and second coupling portions are form-fitting with respect to each other.

From the above, it can be seen that the present invention includes a coupling forming a means for, when the linear actuator is mounted in a linear actuator mounting, and the drive rod is moved toward the slider valve unit, automatically coupling the drive rod with the push rod. This means further, when the linear actuator is removed from the linear actuator mounting, automatically uncouples the drive rod from the push rod.

BRIEF DESCRIPTION OF THE DRAWINGS

Further objects, features and advantages of the present invention will become clear from the following detailed description of preferred embodiments of the invention taken together with the accompanying drawings, in which.

DETAILED DESCRIPTION OF THE PREFERRED EMBODIMENTS

Figure 1:
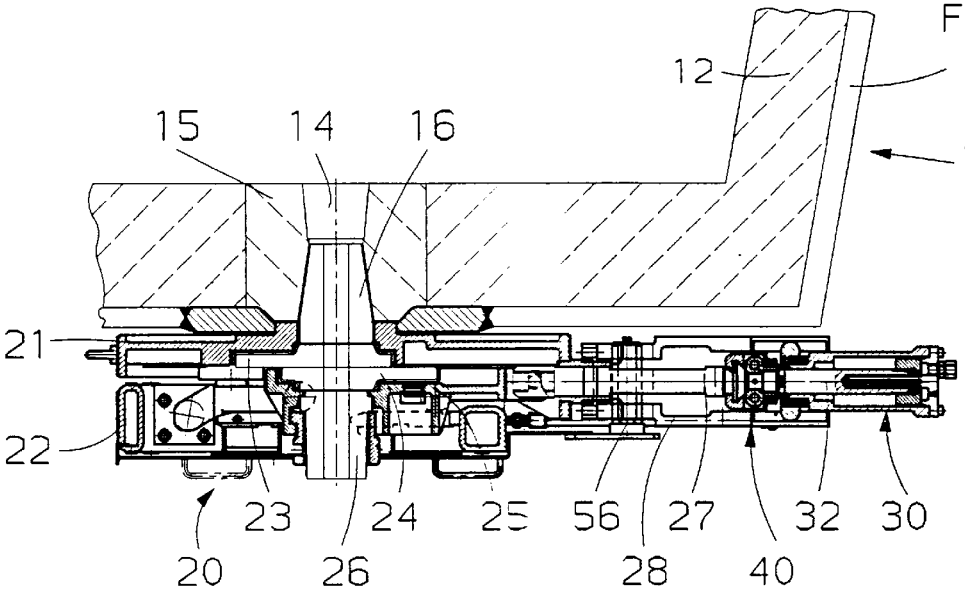
FIG. 1 is a partial sectional side view of a molten metal vessel, illustrating a sliding gate valve having a coupling in accordance with the present invention.

The following is a detailed description of preferred embodiments of the present invention. Similar reference numbers used in the drawings refer to the same or similar elements. A first embodiment is discussed with respect to FIGS. 1–5, and a second embodiment referring to FIGS. 6 and 7.

Describing now the first embodiment, FIG. 1 shows a sliding gate valve 20 mounted on a molten metal vessel 10 that is partially illustrated in the figure. In the illustrated example, the molten metal vessel 10 is a so-called ladle. It has an outer steel shell 11, in a conventional manner, a refractory lining 12 embedded in the outer steel shell 11 and an outlet 14. The outlet is constituted by a refractory nozzle brick 15 and a refractory sleeve 16.

Disposed at the outlet 14 is the sliding gate valve 20, which has an upper housing portion 21 with a refractory base plate 23 inserted therein, a housing frame 22 and a slider unit 25 releasably clamped in the housing frame 22. A refractory sliding plate 24 and a discharge sleeve 26 are connected to the slider unit 25. The outlet 14 can thus be throttled or closed by longitudinal movement of the slider unit 25 and the slider plate 24 in the slider unit 25. This kind of sliding gate valve 20 is known per se, and is described in detail, for example, in publication EP-A-B1-0277146, and thus will not be described in complete detail herein.

The slider unit 25 is connected to a linear actuator 30 for linear or longitudinal back and forth movement. The linear actuator 30 is preferably a hydraulic piston/cylinder unit. The push rod 27 of the slider unit 25 is connected to the linear actuator 30 by a coupling 40.

The linear actuator is removably mounted in a mounting 28. The mounting 28 is flange connected to the upper housing portion 21. Commonly, the linear actuator 30 is left on a pouring platform of a continuous casting installation, in contrast to the ladle 10. The linear actuator is then installed on the ladle 10, which is filled with molten steel and is equipped with the sliding gate valve 20, when the ladle 10 is brought to the pouring platform. After emptying the ladle 10, the linear actuator 30 is again removed from the ladle 10 so that the ladle 10 can be transferred, for example by means of a crane, away from the pouring platform, back to a ladle station or the like to be refilled with molten steel.

The linear actuator 30 has a simple installation and removal procedure from the ladle. In a manner which is known per se, the linear actuator is slidable transverse to the direction of movement of a drive rod 32 of the linear actuator into and out of the mounting 28. After the linear actuator 30 has been slid into the mounting 28, the drive rod 32 is coupled by the coupling 40 to the push rod 27 of the slide unit 25 in coaxial alignment.

In accordance with a feature of the present invention, the coupling 40 is so constructed so that when the linear actuator 30 is slid into the mounting 28, it automatically couples, by virtue of movement of the drive rod 38 toward the slider unit 25, the drive rod 32 to the push rod 27. When the linear actuator 30 is removed from the mounting 28, the coupling 40 automatically uncouples the drive rod 32 from the push rod 27.

The coupling 40 includes a coupling portion that is provided on the front side or front end of the drive rod 32. The coupling portion includes at least one, and preferably two, claw elements 41 and 42 that are pivotally mounted on respective axes 44. The coupling 40 further comprises a coupling portion 43 that is formed at the end of the push rod 27 of the slider unit 25. The coupling portion 43 is constructed to form a flange or similar portion capable of being held by the claw elements 41 and 42. The coupling portion 43 preferably has a rectangular cross section as seen in the longitudinal direction, i.e. the direction of movement of the push rod 27 or the drive rod 32. It is further provided, preferably, with oblique guide surfaces 43' (see for example FIG. 4) that extend from the front surface thereof. In a coupled state, the claw elements 41 and 42 engage the coupling portion 43 as illustrated in FIG. 1 in a form-fitting or complementary manner. It can be seen, for example, from the various drawing figures that the shape of the inner surface of the claw elements 41 and 42 are complementary to the coupling portion 43.

Figure 2:
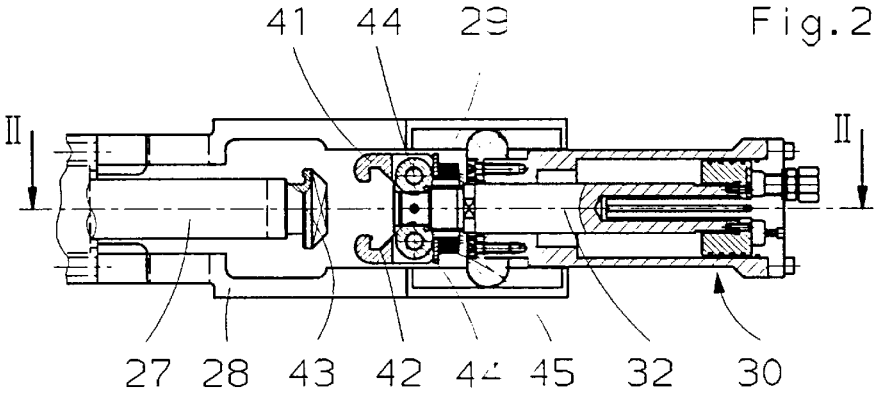
FIG. 2 is a sectional side view of a linear actuator and coupling according to the present invention in an uncoupled state.

As shown in FIG. 2, the claw elements 41 and 42 are arranged parallel or approximately parallel to one another on the front end of the drive rod 32, thus forming pincers. The claw elements 41 and 42 also have rear ends that are engaged by a spring element 45. The spring element 45 produces a torque on the claws 41 and 42 such that they tend to be pressed inwardly at their front ends, but only until they reach the position in which they are parallel or approximately parallel to one another. Preferably, the spring element 45 is composed of a plurality of plate springs 45', or the like, which are held by the drive rod 32 as for example illustrate in FIG. 5.

Figure 3:
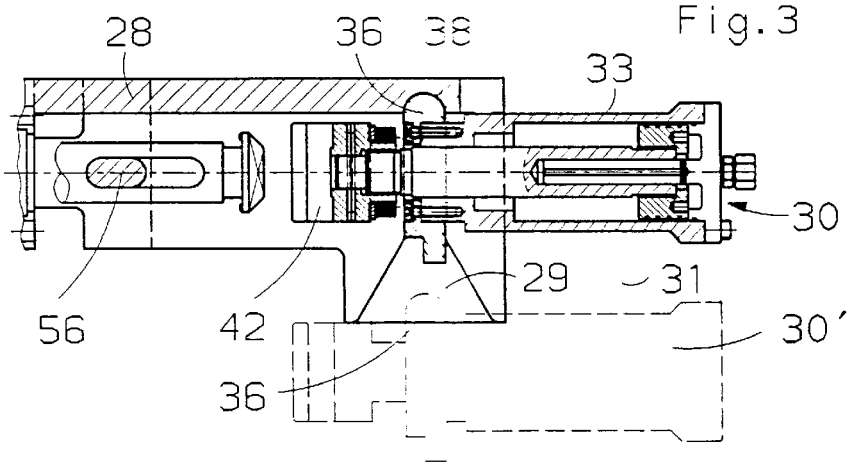
FIG. 3 is a sectional view of the linear actuator and the coupling of FIG. 2 taken along line III—III.

FIG. 3 illustrates lateral sliding of the linear actuator 30. The linear actuator 30 is represented by reference number 30' and by chain lines in its unmounted or dismounted position. From this position, it is slid into the mounting 28. The linear actuator 30 has a cylinder 33 that is provided with a guide element 36 on a front end thereof. The guide element 36 extends transverse to the cylinder 33, and projects externally of the cylinder 33, as can be seen from the figure. When the cylinder 33 is moved in the direction of the arrow 31 in the figure, the guide element slides into and is guided by a conical opening 29 in the mounting 28. The guide element 36 then further enters into a guide groove 38 provided in the mounting 28 as illustrated by the solid line drawing of the linear actuator 30 in FIG. 3. The guide groove 38 is U-shaped in cross section and dimensioned so that the guide element 36 is retained in the guide groove 38 in an approximate form-fitting manner. The conical shape of the opening 29 enables linear actuator 30 to be comfortably slid into the mounting 28, particularly if the linear actuator 30 is to be actuated by a manipulator (not illustrated).

Still noting FIG. 3, a travel limiting peg 56 is provided on the mounting 28. It passes through an elongate hole in the push rod 27 and serves to limit the travel of the slider unit 25 with respect to the closed position of the sliding gate valve.

Figure 4:
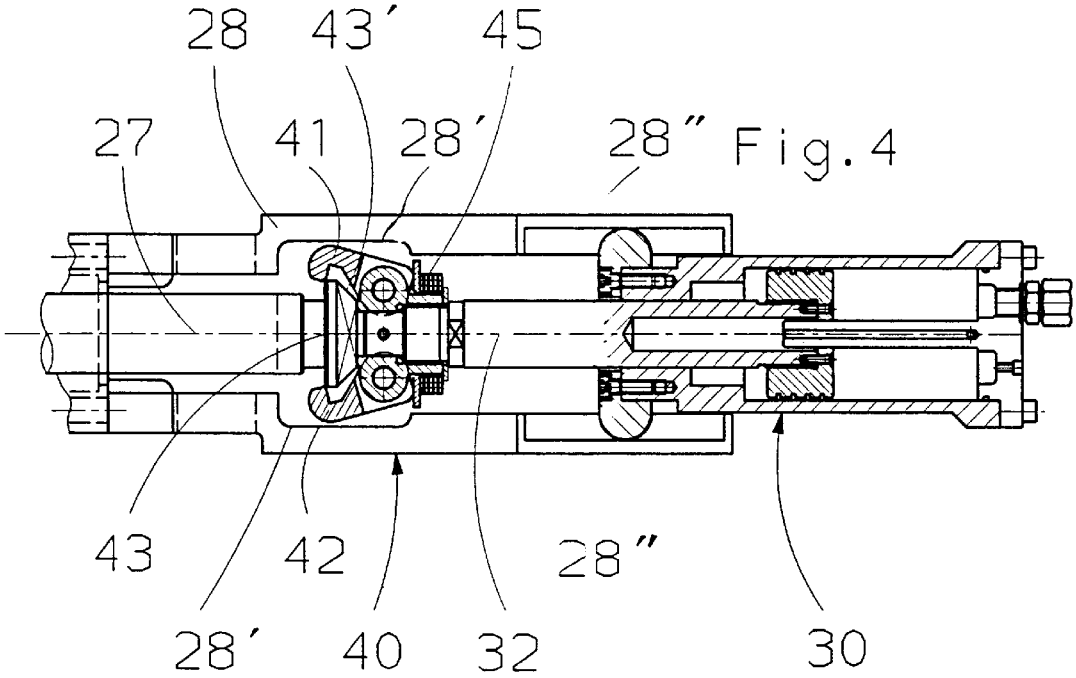
FIG. 4 is a view similar to FIG. 2, but showing the linear actuator and the coupling during a coupling process.
Figure 5:
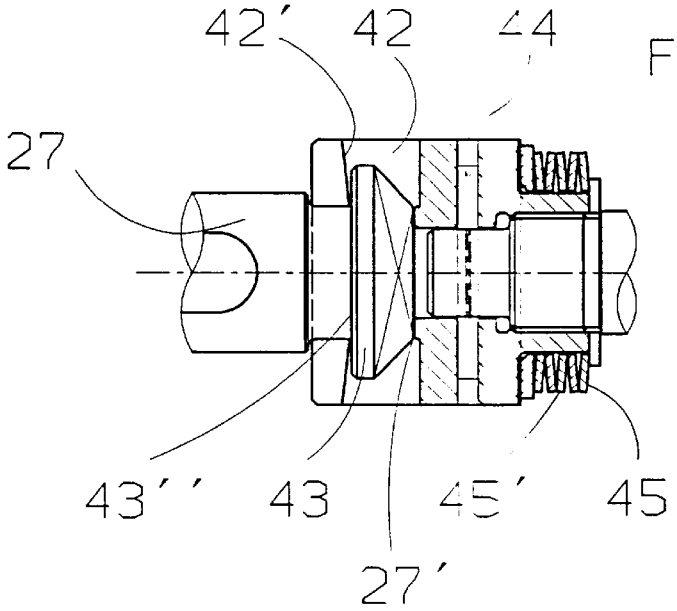
FIG. 5 is an enlarged partial sectional view of the coupling of FIG. 4 showing the coupling in the coupled state and from a view perpendicular to that of FIG. 4.

In coupling the coupling portion 43 with the coupling portion comprised of the claw elements 41 and 42, the drive rod 32 is moved, as shown in FIGS. 4 and 5, by the linear actuator 30 toward the push rod 27 of the slider unit 25 until it reaches the illustrated end position. This position corresponds to a closed position of the sliding gate valve 20. As the drive rod 32 advances further after the claw elements 41 and 42 have initially engaged the guide surfaces 43' of the coupling portion 43, they are spread outwardly along the guide surfaces 43', into the position illustrated in FIG. 4, until they snap inwardly as a result of the spring force of the spring element 45, and thus engage around the coupling portion 43 in a form-fitting manner. In the snap-in or coupled state, a contact surface 27' on the end of the push rod 27 engages the claw elements 41 and 42 as illustrated in FIG. 5, and contact surfaces 42' on the claw elements 41 and 42 engage a contact surface 43" on the coupling portion 43 so as to provide a connection that is free or nearly free from play in the coupled state. The contact surface 42' of the claw elements 41 and 42 is advantageously convexly cambered in order to satisfactorily snap in upon engagement, as clearly shown in FIG. 5. The respective contact surfaces 27', 42', and 43" could advantageously be arranged at a few degrees more than 90° to the direction of movement so that the claw elements would engage behind the flange projection on the coupling portion 43 in order to prevent undesired decoupling.

After coupling, the drive rod 32 can be operated over a suitable travel range. In this regard, a further advantage in accordance with the present invention is produced as a result of the construction of the mounting 28. That is, as can be seen from FIG. 4, the mounting 28 is provided with an inner surface 28' at which coupling takes place, and an inner surface 28" along which normal operation takes place. The inner surface 28' of the mounting 28 is offset outwardly with respect to the inner surface 28". That is, in the region of the illustrated coupling position of FIG. 4, the inner surface is wider than the inner surface in a region in the normal operating position. The effect is that the claw elements 41 and 42 are, during normal operation, prevented by the inner surface 28" from opening up. Thus in the normal travel range or operating range, the claw elements 41 and 42 are effectively locked in the coupled position by the surface 28". Thus the inner surfaces 28" are arranged parallel to the direction of movement and at a small spacing from the outer surfaces from the claw elements 41 and 42, resulting in the claw elements 41 and 42 being secured from uncoupling.

Automatic decoupling in accordance with the present invention takes place as follows. The linear actuator 30 can be pulled out transversely to the direction of movement of the drive rod 32 and the push rod 27 while still in the coupled position of the coupling 40 without any additional manipulation and in any desired travel position of the drive rod 32. This is because the claw elements 41 and 42 are arranged on the drive rod 32 with their respective pivot axes 44 extending parallel to one another and in the same direction as the direction of withdrawal of the linear actuator 30. This can be seen from FIG. 3, for example. During the withdrawal of the linear actuator 30, the two claw elements 41 and 42 thus slide in their closed or snapped-in state transverse to the longitudinal direction of the push rod 27 on the coupling portion 43 until they are laterally released from the coupling portion 43.

A second embodiment according to the present invention will now be described with reference to FIGS. 6 and 7. As noted above, similar elements are illustrated with similar reference numerals.

Figure 6:
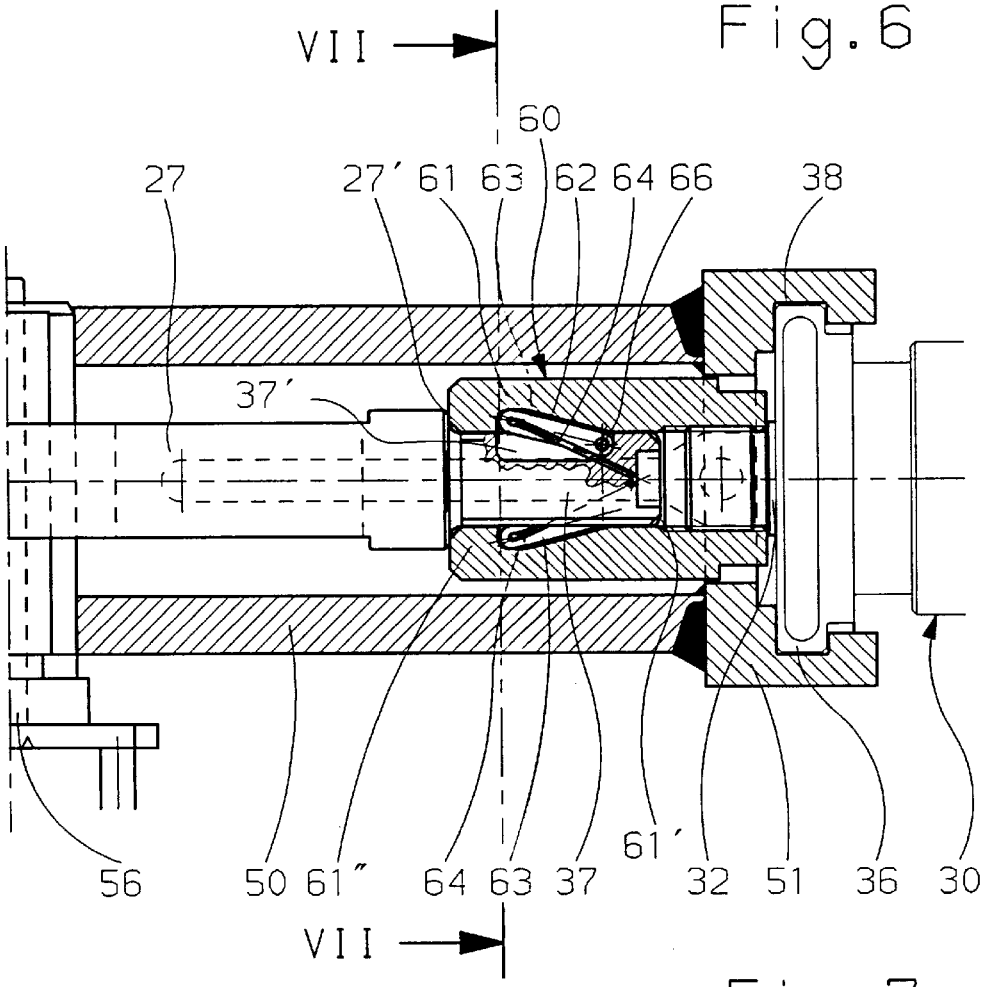
FIG. 6 is a partial sectional side view of a second embodiment of a coupling according to the present invention, shown in a coupled state.
Figure 7:
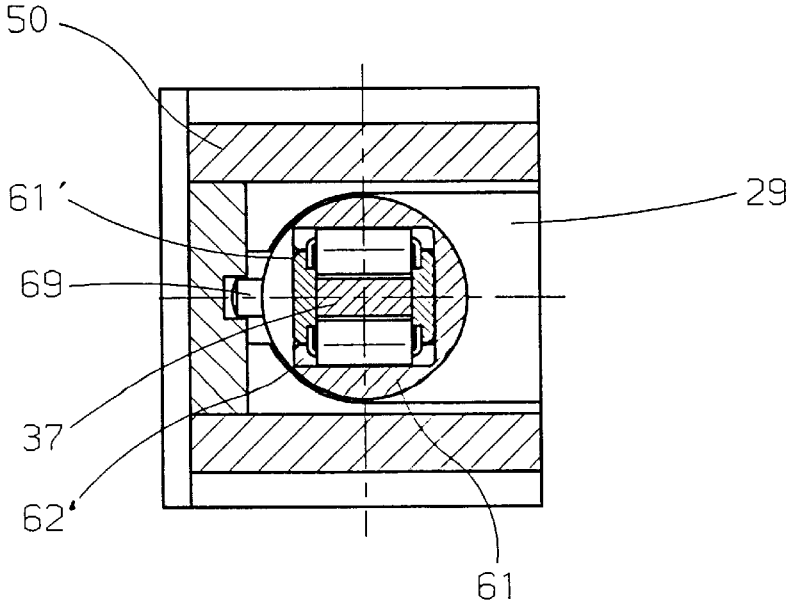
FIG. 7 is a sectional view of the coupling of FIG. 6 taken along line VII—VII.

In this embodiment, a coupling 60 is illustrated in FIG. 6 in the coupled state connecting the push rod 27 of the slider unit 25 to the drive rod 32 of the linear actuator 30. The mounting is in this case designated by reference number 50, and the mounting 50 is secured to an upper housing portion 56 of the sliding gate valve, which is not shown in detail with respect to the second embodiment. The mounting 50 serves to receive and retain the linear actuator 30. For this purpose, a transverse guide groove 38 is provided in an end surface of the mounting 50. A corresponding guide element 36, which may be slid into the guide groove 38 in an approximate form-fitting manner, is provided on the linear actuator 30.

The coupling 60 of this embodiment includes one coupling portion that is arranged in the push rod 27, and another coupling portion that cooperates with the coupling portion on the push rod 27 that is arranged on the front end of the drive rod 32. The coupling portion on the drive rod 32 is formed by a coupling sleeve 61 mounted to the drive rod 32. The coupling sleeve 61 has an internal opening 61' of a rectangular cross section that is laterally open on one side, as illustrated in FIG. 7. Furthermore, as can be seen from FIG. 6, the front end of the coupling sleeve 61 is also open. Transverse grooves 62 are formed internally in the sleeve 61 as further shown in FIG. 6. A peg 69 is provided on one side of the sleeve 61 for engaging in an elongate groove formed in the mounting 50.

Thus, as may readily be appreciated, the coupling sleeve 61 may be slid over the coupling portion of the push rod 27 in the longitudinal direction or direction of movement by movement or actuation of the drive rod 32. The sleeve 61 is prevented from rotating by the engagement of the peg 69 with the groove formed in the mounting 50. The linear actuator 30 may be removed in its entirety by sliding it in a direction transverse to the direction of movement of the push rod 32, i.e. to the right in FIG. 7. The laterally open portion of the opening portion of the opening 61' allows the coupling sleeve 61 to be removed from the push rod 27, as may readily be appreciated.

The coupling portion of the push rod 27 includes a central peg 37 that is adapted to fit into the opening 61' of the coupling portion of the drive rod 32. Two pawls 63 are mounted on the central peg 37 so as to be pivotal approximately radially relative to the central peg 37 about respective axes 66. They are pressed by respective bending springs 64 mounted on the central peg 37 into the position illustrated in FIG. 6. In the coupled state, the pawls 63 are engaged in respective transverse grooves 62 of the coupling sleeve 61 such that an inwardly projecting forward annular portion 61' of the coupling sleeve 61 is held between the pawls and a rear abutment surface 27' of the push rod 27. In this coupled position, the push rod 27, along with the slider unit 25, can be moved back and forth by the drive rod 32.

Accordingly, coupling and uncoupling of the linear actuator 30 to and from the upper housing portion 56 can also be achieved in accordance with the present invention by using the coupling 60. Thus when coupling, the linear actuator 30 is first slid into the mounting 50 in a similar manner as that illustrated in FIG. 3 so that the guide element 36 complementarily engages with the guide groove 38. Thereafter, the linear actuator 30 is actuated, and the drive rod 32 extends until the sleeve 61 is pushed over the central peg 37. The pawls 63 are thus forced inwardly into respective recesses 37' of the central peg 37. As soon as the annular portion 61" of the coupling sleeve 61 comes into contact with the abutment surface 27' on the push rod 27, the pawls 63 snap into the transverse groove 62. Thus, coupling is achieved without any further or additional manipulations.

When uncoupling the linear actuator 30, it can be withdrawn at any desired travel position of the push rod 27 in a direction transverse to the direction of movement of the drive rod 32. That is, as can be seen from FIG. 7, the coupling sleeve 61 can be released in a direction transverse to the axis or direction of movement due to the coupling sleeve 61 being open on one side and due to the construction of the transverse grooves 62 so as to be open at the open side of the coupling sleeve as illustrated at 62'. Further, the mounting 50 is opened as illustrated by lateral opening 29 to allow the removal of the linear actuator 30.

While the present invention has been thoroughly described and explained above with respect to these two preferred embodiments thereof, it should be realized that the present invention could be achieved with different constructions. For example, only one pivotal claw element and one opposed complementary abutment surface for centering and engaging the two coupling portions might be provided. The claw element could, in principle, engage in an elongate recess groove, provided at the end of the push rod 27. The coupling portion with the claw elements could equally well be provided on the push rod of the slider unit, it should be noted, and the corresponding coupling portion having a flange or flange-like construction could be provided on the drive rod of the linear actuator. In any case, such modifications should be considered within the scope of the present invention as reflected by the appended claims.

We claim:

1. A sliding gate valve for a molten metal vessel, comprising:

a slider housing:

a slider valve unit slidably mounted in said slider housing for movement in a longitudinal direction, said slider unit having a push rod;

a linear actuator mounting on said slider housing;

a linear actuator that can be mounted in said linear actuator mounting on said slider housing and that can be removed from said linear actuator mounting on said slider housing, said linear actuator having a drive rod movable in the longitudinal direction when said linear actuator is mounted in said linear actuator mounting on said slider housing; and a coupling having a structure such that when said linear actuator is mounted in said linear actuator mounting and said drive rod is moved toward said slider valve unit said coupling automatically couples said drive rod with said push rod, and such that when said linear actuator is removed from said linear actuator mounting said coupling automatically uncouples said drive rod from said push rod;

wherein said coupling comprises:

a first coupling portion on and end of said push rod of said slider valve unit; and a second coupling portion on a front end of said drive rod of said linear actuator;

wherein one of said first and second coupling portions comprises at least one pivotally mounted claw element; and wherein the other of said first and second coupling portions comprises a flanged coupling portion such that when said coupling is in a coupled state, said at least one pivotally mounted claw element engages said flanged coupling portion.

2. The sliding gate valve of claim 1, wherein:

said at least one claw element comprises two pivotally mounted claw elements which are parallel to each other in an uncoupled state of said coupling and which are arranged to form pincers;

said two pivotally mounted claw elements have front and rear portions; and a spring element engages said rear portions of said two pivotally mounted claw elements such that said front portions are biased toward each other.

3. The sliding gate valve of claim 2, wherein second coupling portion comprises said two pivotally mounted claw elements being pivotally mounted to a front end of said drive rod and said spring element being mounted on said drive rod.

4. The sliding gate valve of claim 1, wherein said flanged coupling portion has a rectangular cross section, an end face facing in the longitudinal direction, and guide surfaces on said end face for engaging said at least one claw element and guiding said claw element to pivot outwardly until engaging said flanged coupling portion during movement of said drive rod toward said slider valve unit and said first coupling portion toward said second coupling portion.

5. The sliding gate valve of claim 1, wherein said linear actuator mounting has an inner surface facing said push rod, said drive rod and said coupling when said linear actuator is mounted in said linear actuator mounting, said inner surface extending along an operational travel path of said drive rod and said push rod, and said inner surface having first and second inner surface portions, said first inner surface portion corresponding to a coupling position at which said coupling is formed between said drive rod and said push rod by said first and second coupling portions and said second inner surface portion corresponding to an operating range of said drive rod along which said drive rod is operated when coupled to said push rod for movement of said slider valve unit, said first inner surface portion being sufficiently large in diameter to permit said at least one claw element to open such that said first and second coupling portions can be coupled together, and said second inner surface portion being sufficiently narrow in diameter to prevent said at least one claw element from opening to such an extent that said first and second coupling portions could be uncoupled.

6. The sliding gate valve of claim 4, wherein said linear actuator mounting has an opening therein such that said linear actuator can be withdrawn therefrom in a direction transverse to the longitudinal direction when said at least one claw element is engaged with said flanged coupling portion, said at least one claw element and said flanged coupling portion having mutual contact surfaces, and wherein upon withdrawal of said linear actuator from said linear actuator mounting said at least one claw element slides on said flanged coupling portion until being uncoupled.

7. The sliding gate valve of claim 6, wherein said mutual contact surfaces of said at least one claw element and said flanged coupling portion, when said first and second coupling portions are coupled, extend at right angles with respect to the longitudinal direction such that upon withdrawal of said linear actuator from said linear actuator mounting said at least one claw element slides on said flanged coupling portion until being uncoupled.

8. A sliding gate valve for a molten metal vessel, comprising:

a slider housing:

a slider valve unit slidably mounted in said slider housing for movement in a longitudinal direction, said slider unit having a push rod;

a linear actuator mounting on said slider housing;

a linear actuator that can be mounted in said linear actuator mounting on said slider housing and that can be removed from said linear actuator mounting on said slider housing, said linear actuator having a drive rod movable in the longitudinal direction when said linear actuator is mounted in said linear actuator mounting on said slider housing; and a coupling having a structure such that when said linear actuator is mounted in said linear actuator mounting and said drive rod is moved toward said slider valve unit said coupling automatically couples said drive rod with said push rod, and such that when said linear actuator is removed from said linear actuator mounting said coupling automatically uncouples said drive rod from said push rod;

wherein said coupling comprises:

a first coupling portion on an end of said push rod;

a second coupling portion on a front end of said drive rod of said linear actuator;

wherein one of said first and second coupling portions comprises a central peg having projecting pivotal pawls on both sides thereof and an abutment surface; and wherein the other of said first and second couplings comprises a sleeve having transverse grooves complementary with and capable of receiving said pivotal pawls of said central peg and a front annular portion, such that when said first and second coupling portions are coupled with each other, said central peg is slid in to said sleeve, said pawls engage said transverse grooves and said front annular portion is located between said pawls and said abutment surface.

9. The sliding gate valve of claim 8, wherein said linear actuator mounting has an opening therein such that said linear actuator can be withdrawn therefrom in a direction transverse to the longitudinal direction when said first and second coupling portions are coupled with each other, said sleeve having an opening on one side thereof so as to permit said central peg and said pawls to slide out of said sleeve in the direction transverse to the longitudinal direction such that said sleeve and said central peg are uncoupled and said pawls are disengaged from said transverse grooves.

10. A sliding gate valve for a molten metal vessel, comprising:

a slider housing:

a slider valve unit slidably mounted in said slider housing for movement in a longitudinal direction, said slider unit having a push rod;

a linear actuator mounting on said slider housing;

a linear actuator that can be mounted in said linear actuator mounting on said slider housing and that can be removed from said linear actuator mounting on said slider housing, said linear actuator having a drive rod movable in the longitudinal direction when said linear actuator is mounted in said linear actuator mounting on said slider housing; and a coupling having a structure such that when said linear actuator is mounted in said linear actuator mounting and said drive rod is moved toward said slider valve unit said coupling automatically couples said drive rod with said push rod, and such that when said linear actuator is removed from said linear actuator mounting said coupling automatically uncouples said drive rod from said push rod;

wherein said coupling has a structure such that when said linear actuator is mounted in said linear actuator mounting and said drive rod is moved toward said slider valve unit said coupling automatically couples said drive rod with said push rod, and such that when said linear actuator is removed from said linear actuator mounting in a direction transverse to the longitudinal direction said coupling automatically uncouples said drive rod from said push rod.

11. A coupling arrangement for a sliding gate valve of a molten metal vessel in which a slider housing is mounted below an opening of the molten metal vessel and receives a slider valve unit for opening and closing the opening of the molten metal vessel, the slider valve unit being capable of being slid in a longitudinal direction and having a push rod, and in which a linear actuator is provided for moving the slider valve unit and is adapted to be removably mounted in a linear actuator mounting, said linear actuator comprising a drive rod, and said coupling arrangement comprising:

a first coupling portion on one of the drive rod and the push rod;

a second coupling portion on the other of the drive rod and the push rod;

wherein said first coupling portion comprises a coupling member biased into a coupling position and said second coupling portion is engagable by said coupling member such that when the linear actuator is mounted in the linear actuator mounting, before said first and second coupling portions are coupled with each other, and the drive rod is moved toward the push rod, the first and second coupling portions automatically couple with each other; and an opening in the linear actuator mounting provided in a direction transverse to the longitudinal direction such that the linear actuator can be removed from the linear actuator mounting in the transverse direction through said opening from a state in which said first and second coupling portions are coupled by having said coupling member and said coupling portion slide relative to each other in the direction transverse to the longitudinal direction until said first and second coupling portions are uncoupled from each other.

12. The coupling arrangement of claim 11, wherein said first coupling portion comprises at least one claw and said second coupling portion forms a flange for engagement by said at least one claw.

13. The coupling arrangement of claim 12, wherein said second coupling portion comprises an oblique surface for engagement with said at least one claw to guide said at least one claw into a coupled state engaging said flange.

14. The coupling arrangement of claim 11, wherein said first coupling portion comprises a spring biasing said coupling member into said coupling position.

15. The coupling arrangement of claim 11, and further comprising:

a guide surface on the linear actuator mounting;

a guide groove adjacent to said guide surface in an inner surface of the linear actuator mounting; and a guide element on the linear actuator for guidance by said guide surface and engagement with said guide groove.

16. The coupling arrangement of claim 11, and further comprising an inner surface of the linear actuator mounting having a first width at a coupling position and a second width over an operating range of the linear actuator, the first width being larger than the second width to allow said first and second coupling portions to couple, and to prevent said first and second coupling portions from uncoupling during operation.

17. The coupling arrangement of claim 11, wherein said first and second coupling portions have respective complementary surfaces such that in said coupled position, said first and second coupling portions are formfitting with respect to each other.

18. The coupling arrangement of claim 11, wherein said coupling member comprises a pawl and said second coupling portion comprises a sleeve having a transverse groove for receiving said pawl.

19. The coupling arrangement of claim 18, wherein said sleeve has a lateral opening facing in the transverse direction.

20. The coupling arrangement of claim 18, wherein said sleeve further comprises one abutment surface, said second coupling portion comprises another abutment surface, and said one and another abutment surfaces are in abutment with each other when said first and second coupling portions are in said coupled position.

* * * * *